US006276942B1

(12) United States Patent
Hsiao

(10) Patent No.: US 6,276,942 B1
(45) Date of Patent: Aug. 21, 2001

(54) TERMINAL FOR BOARD TO BOARD CONNECTOR

(75) Inventor: ShihWei Hsiao, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/503,005

(22) Filed: Feb. 11, 2000

(30) Foreign Application Priority Data

Oct. 21, 1999 (TW) ..... 088217915

(51) Int. Cl.[7] ..... H01R 12/22
(52) U.S. Cl. ..... 439/74
(58) Field of Search ..... 439/74, 660, 862

(56) References Cited

U.S. PATENT DOCUMENTS 5,639,248 * 6/1997 Yagi ..... 439/74
5,873,742 * 2/1999 McHugh ..... 439/74
5,885,092 * 3/1999 Ito et al. ..... 439/74
5,921,787 * 7/1999 Pope et al. ..... 439/660
5,931,689 * 8/1999 Patel ..... 439/74
5,964,594 * 10/1999 Saitoh et al. ..... 439/74
6,036,504 * 3/2000 McHugh et al. ..... 439/660

* cited by examiner

*Primary Examiner*—Gary F. Paumen
(74) *Attorney, Agent, or Firm*—Wei Te Chung

(57) ABSTRACT

An electrical connector comprises a dielectric housing which defines two rows of chambers being in communication with a pair of slots and defined by a number of dividers, and a number of terminals received in the chambers. Each terminal includes a base, a soldering tail, a spring beam, a curved beam continuing the spring beam and a contacting beam. The base of each terminal has a number of embossments interferentially engaging with adjacent dividers for preventing the base from buckling during assembly and a number of barbs for securing the terminal by interferentially mating with the housing. The base further has a pair of recesses beside the spring beam for improving the compliance of the contacting beam in mating with a complementary connector. A neck is provided between the base and the soldering tail such that ensuring an even soldering of the soldering tails to a circuit board.

1 Claim, 6 Drawing Sheets

TERMINAL FOR BOARD TO BOARD CONNECTOR

BACKGROUND OF THE INVENTION

1. The Field of the Invention

The present invention relates to a board to board connector, and particularly to terminals for a board to board connector.

2. Brief Description of the Prior Art

U.S. Pat. No. 5,224,866 (shown in FIG. 6) discloses a protrusion-type board-to-board connector 5. The connector 5 includes an elongate dielectric housing 51 which defines a plurality of chambers 511 extending in pairs vertically and equidistantly through the housing 51 along a length thereof, and a plurality of contacts 53 received in the chambers 511. Each contact 53 is generally J-shaped and has a base 531, a connecting portion 532 vertically projecting from the base 531, a curved portion 533 downwardly continuing the connecting portion 532, and an engaging portion 535 which forms a protrusion 534 at a tip thereof. The protrusion 534 fits within a concave portion of a contact of a complementary connector when it is mated with the connector 5. The contact 53 further comprises a fit portion in a form of barbs extending sideward for having an interference fit with the housing 51 of the connector 5. Furthermore, to increase the compliance of the contact 53, an arcuated recess 537 is defined between the base 53 and the connecting portion 532.

As the profile of the contact is getting lower and the thickness of the contact is getting thinner, the conventional contact has the following disadvantages.

When mounting the contact 53 into a corresponding chamber 511 of the housing 51, a buckling of the base 531 may occur, which causes the contact 51 to be improperly positioned in the chamber 511. Furthermore, the compliance of the contact 53 is not enough to ensure that the contact 53 have a proper engagement with the contact of the mated complementary connector.

Hence, an improved electrical connector contact is required to overcome the disadvantages of the prior art.

BRIEF SUMMARY OF THE INVENTION

A first object of the present invention is to provide a connector with a plurality of half bellow shaped terminals.

A second object of the present invention is to provide a connector with a plurality of terminals each forming a neck between a base and a soldering tail and a plurality of embossments on opposite side surfaces of the base.

To achieve the above objects, a board to board connector includes an elongated housing and a plurality of terminals received in the housing.

The housing has a main body between a pair of opposite side walls whereby a pair of slots are defined between the side walls and the main body. A plurality of dividers depends laterally from a central wall which extends along the central line of the main body thereby defining a plurality of chambers for receiving the terminals therein.

Each terminal includes a base, a soldering tail extending outwardly from the base, a spring beam angularly extending from the base, a curved beam and a contacting beam. The base comprises a plurality of embossments in a middle thereof for preventing the base from buckling during assembly, a plurality of barbs for interferentially fit with the central wall and the side wall, and a pair of recesses beside the spring beam for improving the compliance of the contacting beam mating with a mating contact of a complementary connector. The base further has a neck at the juncture between the base and the soldering tail so that ensuring the coplanarity of the soldering tails. The spring beam, the curved beam and the contacting beam cooperatively form a half bellow shape.

Other objects, advantages and novel features of the invention will become more apparent from the following detailed description of the present embodiment when taken in conjunction with the accompanying drawings.

DETAILED DESCRIPTION OF THE INVENTION

Figure 1:
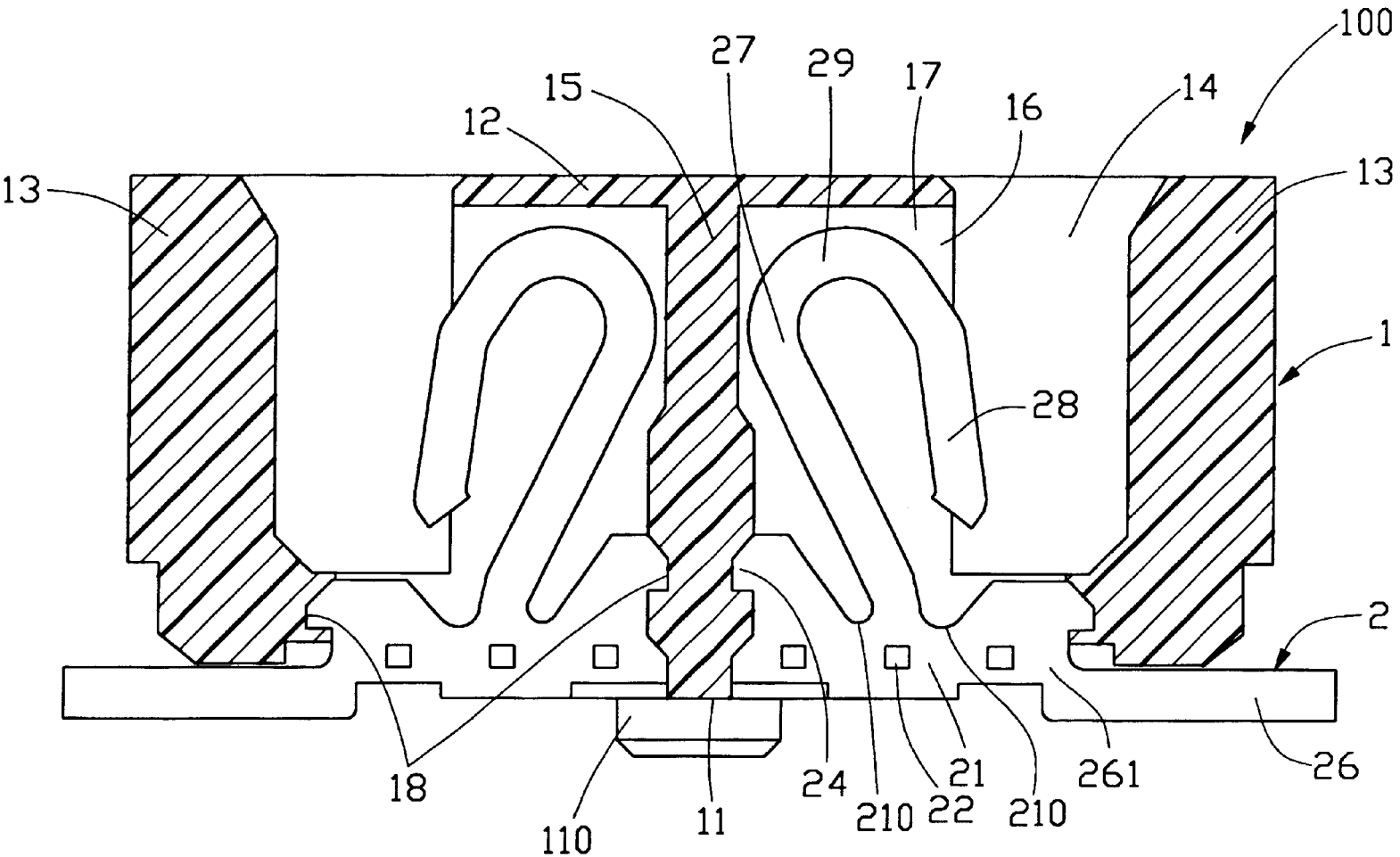
FIG. 1 is a cross-sectional view of a board to board connector of the present invention.

Referring to FIG. 1, a board to board connector 100 in accordance with a first embodiment comprises an elongated dielectric housing 1 having a longitudinal central main body 12 between opposite side walls 13 of the housing 1, and a plurality of conductive terminals 2 received in the main body 12 in opposite rows along a length of the housing 1.

The housing 1 is symmetric about a longitudinal central line (not shown) and has a pair of posts 110 (only one shown) at opposite ends thereof for positioning the connector 100 in position relative to a printed circuit board on which the connector 100 is mounted. The central main body 12 and the side walls 13 define a pair of slots 14 therebetween.

The main body 12 forms a central wall 15 along the longitudinal central line (not shown) and a plurality of dividers 16 in opposite rows along a length of the housing 1 which is integral with the central wall 15. The central wall 15 and the dividers 16 thus define a plurality of chambers 17 in two rows. Each chamber 17 communicates with the slot 14 and extends generally from a top surface of the main body 12 to a bottom surface 11 of the housing 1 for accommodating the terminal 2.

Figure 2:
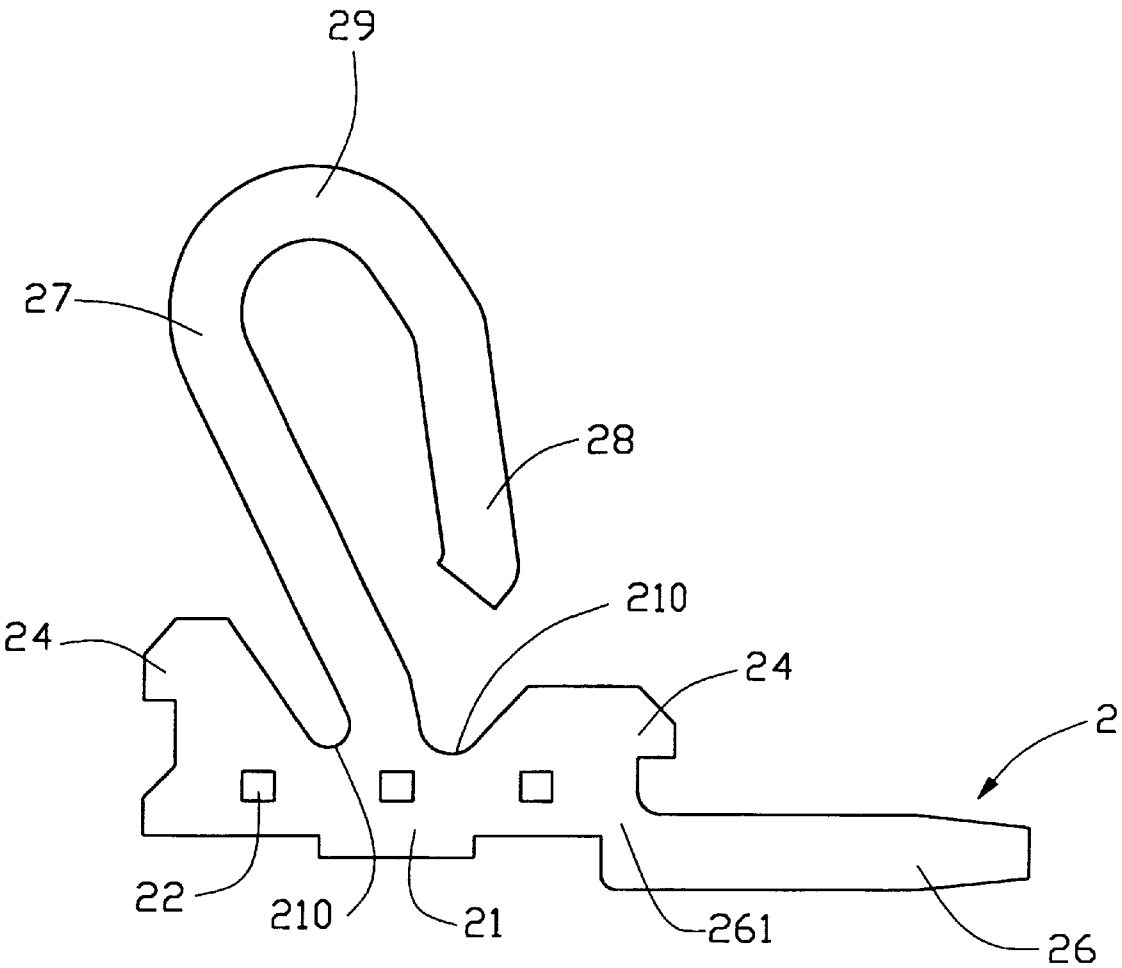
FIG. 2 is an enlarged view of a terminal shown in FIG. 1.

The terminals 2 of the two rows are mirror images of each other. Further referring to FIG. 2, each terminal 2 includes a base 21, a spring beam 27 inwardly and upwardly projecting from the base 21, a contacting beam 28 sloping angularly from vertical and a curved beam 29 intermediate between the spring beam 27 and the contacting beam 28. The spring beam 27, the contacting beam 28, and the curved beam 29 cooperatively form a half bellow shape.

The base 21 forms a plurality of barbs 24 at lateral edges thereof interferentially engaging with the central wall 15 and the side walls 13 of the housing 1. A soldering tail 26 continues from the base 21 and extends beyond the bottom surface 11 of the housing 1 for surface mounting the connector 100 onto the printed circuit board (not shown). A neck 261 is formed between the base 21 and the soldering tail 26 whereby the tail 26 possesses an improved compliance so that the tails 26 can have an improved coplanar feature to ensure an even soldering of the tails 26 to the printed circuit board. Two recesses 210 are defined in the base 21 beside the spring beam 27 so that the compliance of the contacting beam 28 can be largely improved to ensure that the contacting beam 28 can have a reliable engagement with a mating terminal 41 of a complementary connector 4 mating with the connector 100 (see FIG. 3). The base 21 further has a plurality of embossments 22 in a middle thereof. The embossments 22 interferentially engage with adjacent dividers 16 for assuring coplanarity of the base 21 of the terminals 2. The embossments 22 are designed to prevent the base 21 of the terminals 2 from buckling during assembly whereby the terminals 2 can be properly retained in position in the chambers 17. The embossments 22 further improve the strength of the base 21.

The spring beam 27 angularly projects from the base 21 thereby providing better compliance for the terminals 2.

The curved beam 29 connects the spring beam 27 with the contacting beam 28. The contacting beam 28 downwardly and outwardly extends into the slot 14 for engaging with the mating terminal 41 of the mated connector 4 (see FIG. 3). The contacting beam 28 slops angularly from the curved beam 29 and slightly protrudes toward the spring beam 27.

The terminals 2 are stamped from a sheet of phosphor bronze plate whose thickness is 0.15 mm. Such material as phosphor bronze provides the terminals 2 desirable spring characteristics. If thickness of the material is reduced, as to 0.12 mm, the terminals 2 can be further competitive for its reliable compliance thereby being suitable for a high density connector.

Figure 3:
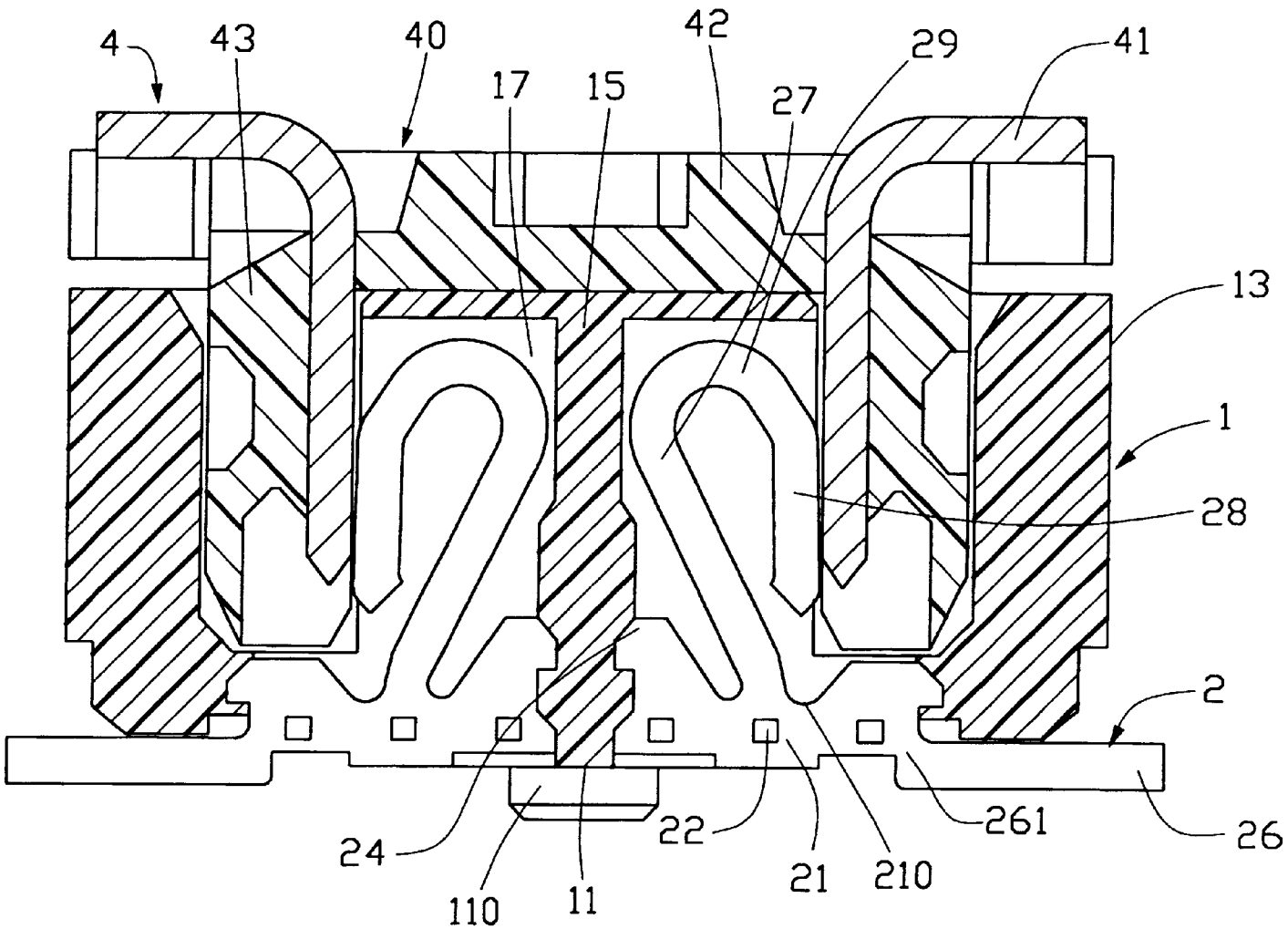
FIG. 3 is a cross-sectional view of the connector of FIG. 1 mated with a complementary connector.

Referring to FIG. 3, the connector 100 mates with the complementary connector 4. The complementary connector 4 includes a dielectric housing 40 and a plurality of terminals 41. The housing 40 has a pair of side walls 43 which defines a top wall 42 therebetween. When the two connectors 1, 4 are mated with each other, the side walls 43 are received in the slots 14. The plurality of terminals 41 of the complementary connector 4 has solder tails (not labeled) on a bottom of the housing 40 for being soldered to a printed circuit board by SMT technology, and engaging ends (not labeled) thereof extending along the side walls 43 for engaging with the terminals 2 of the connector 100. Since the structure and function of the complementary connector 4 is well known to those skilled in the art, a detailed description thereof is omitted herein.

In assembly, the terminals 2 are inserted into the chambers 17 of the housing 1 upwardly from a bottom of the housing 1. The barbs 24 of each terminal 2 have an interferential fit with the central wall 15 and the side wall 13, and the embossments 22 of each terminal 2 have an interferentially fit with adjacent dividers 16 in the housing 1 thereby the terminal 2 is secured in the chamber 17. The soldering tails 26 of the terminals 2 protrude from the housing 1 for soldering connection with the printed circuit board (not shown).

The side walls 43 of the complementary connector 4 extend into the slots 14 of the connector 100, thus the engaging ends (not labeled) of the terminals 41 sliding along the contacting beams 28 of the terminals 2 of the connector 100 to reach a final position electrically and firmly engaging with the terminals 2.

Figure 4:
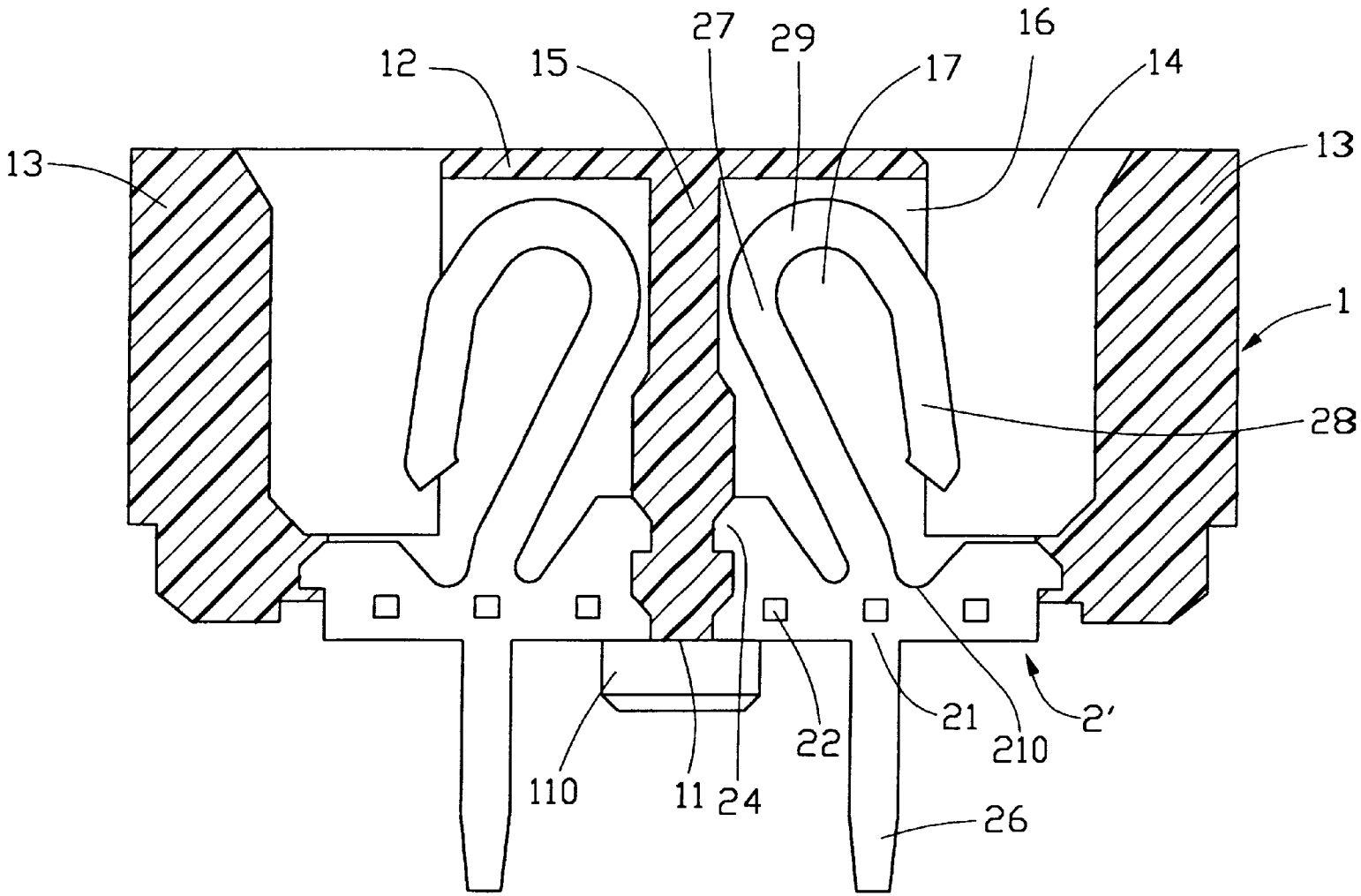
FIG. 4 is a cross-sectional view of a board to board connector in accordance with a second embodiment of the present invention.
Figure 5:
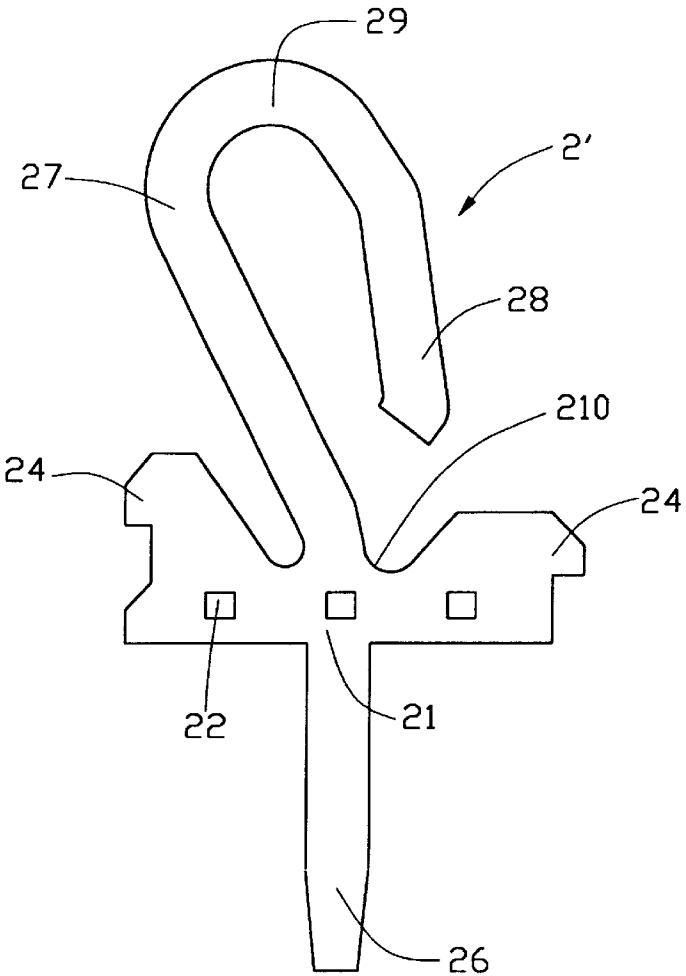
FIG. 5 is a perspective view of a terminal of FIG. 4.
Figure 6:
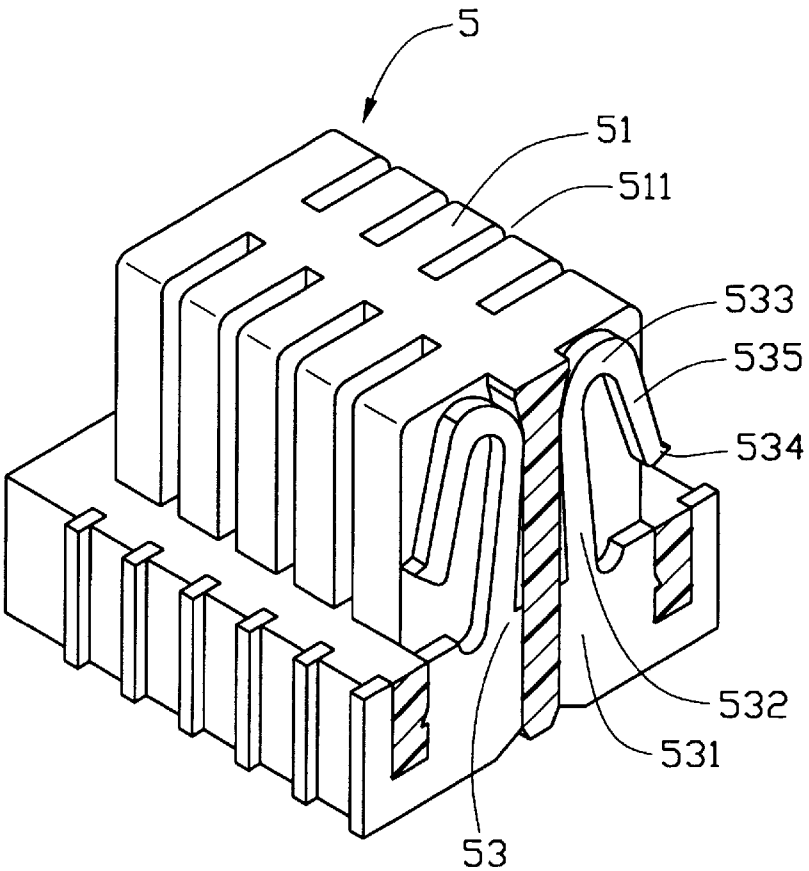
FIG. 6 (PRIOR ART)
FIG. 6 is a perspective view of a conventional board to board connector.

FIGS. 4 and 5 provide a connector in accordance with a second embodiment of the present invention. The connector comprises a dielectric elongate housing 40 being identical with the housing 1 of connector 100 described above and a plurality of terminals 2' received in the housing 1.

The terminals 2' are substantially similar with the terminals 2 of the connector 100, except that the terminals 2' has through-hole type soldering tails 26 which are vertically extended downwardly from the bases 21 of the contacts 2' for being inserted into respective holes in a printed circuit board (not shown) to be soldered thereto.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing including a pair of side walls, a central wall, a pair of slots separating the side walls and the central wall, two rows of dividers along the central wall, the plurality of dividers defining a plurality of chambers therebetween; and a plurality of terminals secured in the chambers and extending into the slots, each terminal comprising:

a base having a plurality of transversely projecting barbs interferentially securing with the central wall and the respective side wall of the housing, and a plurality of embossments interferentially engaging with adjacent dividers for preventing the base from distortion during assembly;

a spring beam angularly depending from the base;

a curved beam continuing the spring beam;

a contacting beam downwardly and outwardly depending from the curved beam and extending into the slot; and a soldering tail extending from the base;

wherein the base further has a neck at the juncture between the base and the soldering tail;

wherein the base has the soldering tail vertically extending from a bottom thereof;

wherein the base forms a pair of recesses near a junction between the spring beam and the base for reducing stress during deflection of the spring beam;

wherein the spring beam angularly depends from the base, and wherein the contacting beam slopes angularly from a mating direction and extends toward the spring beam;

wherein the terminal is stamped from a sheet of metal.

* * * * *